US006159085A

United States Patent [19]

Hara

[11] Patent Number: 6,159,085

[45] Date of Patent: Dec. 12, 2000

[54] STRUCTURE FOR USE IN A POWER DRIVEN TOOL FOR COLLECTING DUST GENERATED BY THE OPERATION OF THE TOOL

[75] Inventor: Akihito Hara, Aichi-ken, Japan

[73] Assignee: Makita Corporation

[21] Appl. No.: 09/170,457

[22] Filed: Oct. 13, 1998

[30] Foreign Application Priority Data

Oct. 16, 1997 [JP] Japan ..... 9-283963

[51] Int. Cl.[7] ..... B24B 55/04

[52] U.S. Cl. ..... 451/451; 451/344; 451/453; 451/456

[58] Field of Search ..... 451/344, 451, 451/453, 456

[56] References Cited

U.S. PATENT DOCUMENTS

| | | | |
|---|---|---|---|
| 3,180,063 | 4/1965 | Milford et al. | 51/170 |
| 3,535,829 | 10/1970 | Dudek . | |
| 3,566,548 | 3/1971 | Jacobus et al. | 51/170 |
| 4,192,104 | 3/1980 | Patenaude . | |
| 4,381,628 | 5/1983 | Dicke . | |
| 4,584,797 | 4/1986 | Wanninkhof et al. | 51/170 |
| 5,833,524 | 11/1998 | Satoh et al. . | |

*Primary Examiner*—Timothy V. Eley
*Assistant Examiner*—Willie Berry, Jr.
*Attorney, Agent, or Firm*—Foley, Hoag & Eliot, LLP

[57] ABSTRACT

There is provided a structure for use in a power driven tool (1) for collecting dust generated by the operation of the tool. The structure includes: an outer housing; a commutation motor (5) disposed within the housing and including a main shaft (6) which has a tip end and a commutator (7) on the main shaft; a pair of brush assemblies (29) radially disposed around, and in contact with, the commutator of the motor; and a dust collecting fan (9) mounted on the main shaft of the commutation motor. The fan is disposed between the commutator and the outer housing. Also included are a dust intake passage (28) formed within the housing and having an intake (27) formed adjacent the location where dust is generated by the operation of the tool; a dust discharge passage (46) formed within the housing and having an outlet; and a dust chamber (43) formed substantially between the outer housing and the commutator for containing the dust collecting fan. The dust chamber has a first connecting portion (35) coupled to the dust intake passage and a second connecting portion (40) coupled to the dust discharge passage. The first and second connecting portions are arranged around the main shaft where they do not overlap the brush assemblies in the axial direction of the main shaft.

10 Claims, 4 Drawing Sheets

STRUCTURE FOR USE IN A POWER DRIVEN TOOL FOR COLLECTING DUST GENERATED BY THE OPERATION OF THE TOOL

BACKGROUND OF THE INVENTION

1. Field of the Invention

The present invention generally relates to structures for use in a power driven tool for collecting dust generated by the operation of the tool. More particularly, the present invention relates to a structure for use in a power driven tool for collecting dust generated from a workpiece through a dust collecting passage in which a dust collecting fan is disposed.

2. Description of the Related Art

A typical conventional structure for collecting dust provided in a power driven tool, such as sanding or polishing device, comprises a dust chamber in which a dust collecting fan fitted around the shaft of a motor is disposed, a dust intake passage which is connected with the dust chamber and has an opening adjacent the part of the device where dust is generated, and a dust discharge passage connected with the dust chamber on one end and having on the other end an outlet to which a dust bag or the like is coupled. The dust intake passage, the dust chamber, and the dust discharge passage together form a dust removal passage; dust is drawn in through the intake and delivered into the dust bag connected to the outlet when the fan is rotated by the operation of the motor.

One of the problems of this type of structure is that relatively large space is required in the axial direction of the motor shaft so as to accommodate the connections of the dust intake passage and the dust discharge passage to the dust chamber, thus increasing the width of the entire device. The problem is particularly exacerbated if a commutator motor, which typically includes a commutator and a pair of brush assemblies provided for the commutator, drives the sanding device. In this case, the dust chamber is connected to the dust intake passage and the dust discharge passage on either side of the plane in which the axes of the brush assemblies are disposed. This tends to broaden the axial width of the dust chamber and adversely affect the weight balance of the entire device, thus reducing the operability of the device. If the width of the dust chamber is reduced to maintain the balance of the device, the connections of the dust intake passage and the dust discharge passage to the dust chamber cannot have sufficient cross sections, thus resulting in a reduced airflow through the passage and efficiency in collecting dust.

SUMMARY OF THE INVENTION

In view of the above-identified problems, an important object of the present invention is to provide a structure used in a power driven tool having a commutator motor for collecting dust that is provided with a dust removal passage with a sufficient cross-sectional area without adversely affecting the weight balance of the tool by increasing the width of the tool.

The above object and other related objects are realized by the invention, which provides a structure for use in a power driven tool for collecting dust generated by the operation of the tool that includes: an outer housing; a commutation motor disposed within the housing and including a main shaft which has a tip end and a commutator on the main shaft; a plurality of brush assemblies radially disposed around, and in contact with, the commutator of the motor; and a dust collecting fan mounted on the main shaft of the commutation motor. The fan is disposed between the commutator and the outer housing. Also included in the dust collecting structure are a dust intake passage formed within the housing and having an intake formed adjacent the location where dust is generated by the operation of the tool; a dust discharge passage formed within the housing and having an outlet; and a dust chamber formed substantially between the outer housing and the commutator for containing the dust collecting fan. The dust chamber has a first connecting portion coupled to the dust intake passage and a second connecting portion coupled to the dust discharge passage. The first and second connecting portions are arranged around the main shaft where they do not overlap the brush assemblies in the axial direction of the main shaft.

According to one aspect of the present invention, the plurality of brush assemblies are a first brush assembly and a second brush assembly, the first brush assembly being positioned diametrically opposite the second brush assembly about the axis of the motor shaft. Further, the commutator has a substantially cylindrical shape having a first flat surface distal to the tip end of the main shaft and a second flat surface proximal to the tip end of the main shaft. In addition, the first and second connecting portions of the dust chamber are arranged on the opposite sides of a plane passing through the first brush assembly, the axis of the main shaft, and the second brush assembly, and extend in the axial direction of the main shaft substantially from the plane in which the first flat surface of the commutator is located to the plane in which the second flat surface of the commutator is located.

According to another aspect of the present invention, the dust chamber includes a scroll plate having an open top and a bottom surface opposing the open top. The dust chamber also includes a cover fitted over the open top of the scroll plate. In addition, the scroll plate has a first level proximal to the tip end of the main shaft, a second level distal to the tip end of the main shaft, and at least one ramp connecting the two levels and the first and second brush assemblies are located immediately outside the scroll plate and adjacent to the first level.

According to still another aspect of the present invention, the dust chamber has a substantially cylindrical shape and the first and second connecting portions are located in the peripheral wall of the cylindrical dust chamber.

According to yet another aspect of the present invention, the scroll plate further includes a center hole through which the tip end of the main shaft of the commutator motor protrudes such that the dust collecting fan is mounted on the main shaft inside the dust chamber between the scroll plate and the cover. Moreover, the dust collecting fan has a center portion which is mounted on the main shaft and a plurality of blades extending radially from the center portion at right angles to the main shaft of the motor, each blade having an inner end connected to the center portion and an outer free end. Furthermore, a circular rib is erected in the axial direction of the main shaft from the bottom surface along, and close to, the outer ends of the blades of the dust collecting fan so as to substantially and circularly divide the dust chamber into an inner side and an outer side along the outer ends of the blades. The inner side is connected to the dust intake passage while the outer side is connected to the dust discharge passage.

BRIEF DESCRIPTION OF THE DRAWINGS

For a fuller understanding of the nature and objects of the present invention, reference should be made to the following detailed description and the accompanying drawings, in which.

DETAILED DESCRIPTION OF THE PREFERRED EMBODIMENT

A preferred embodiment according to the present invention will be described hereinafter with reference to the attached drawings.

Figure 1:
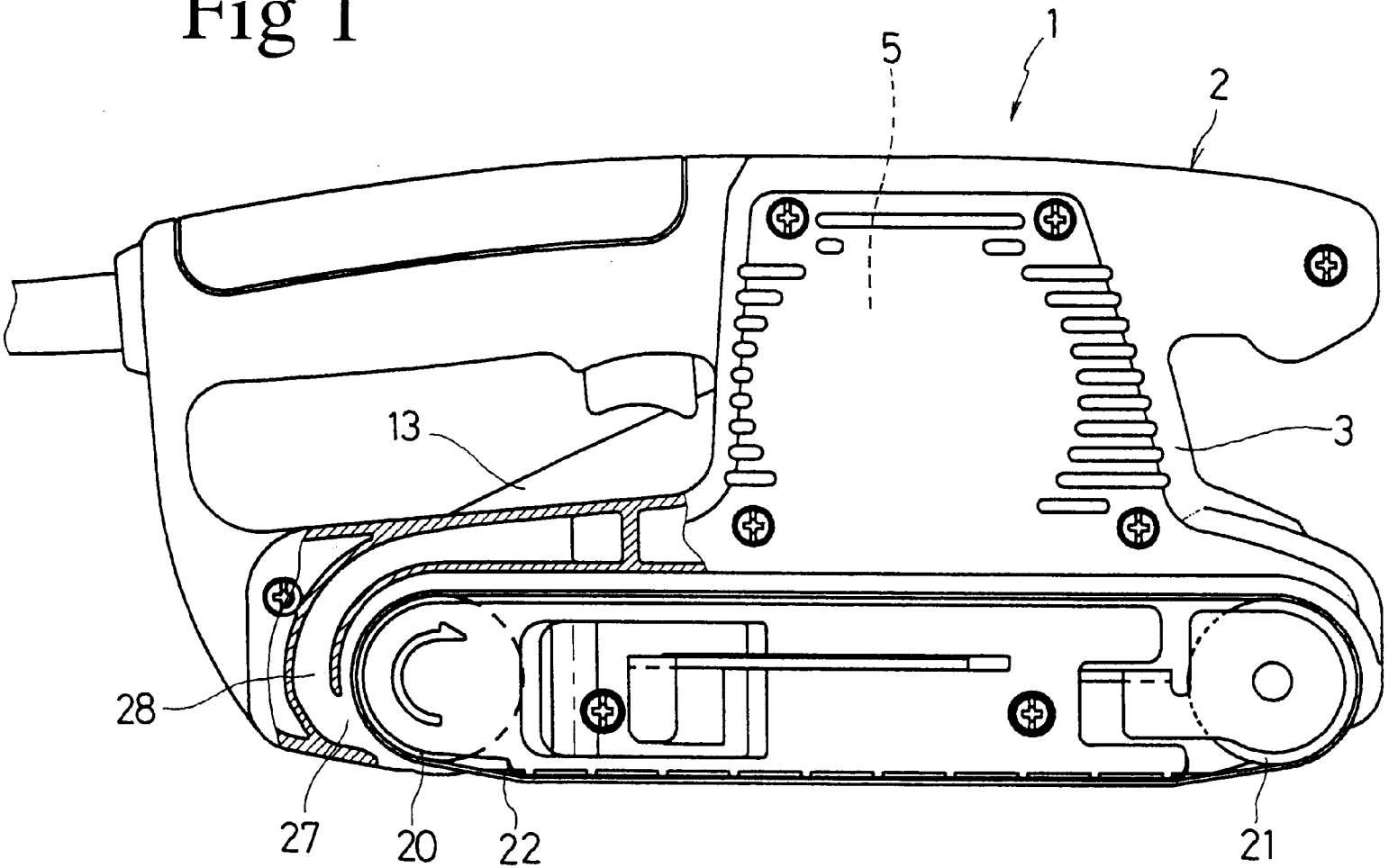
FIG. 1 is a partial cross-sectional side elevation of a belt sander 1 according to the present invention.
Figure 2:
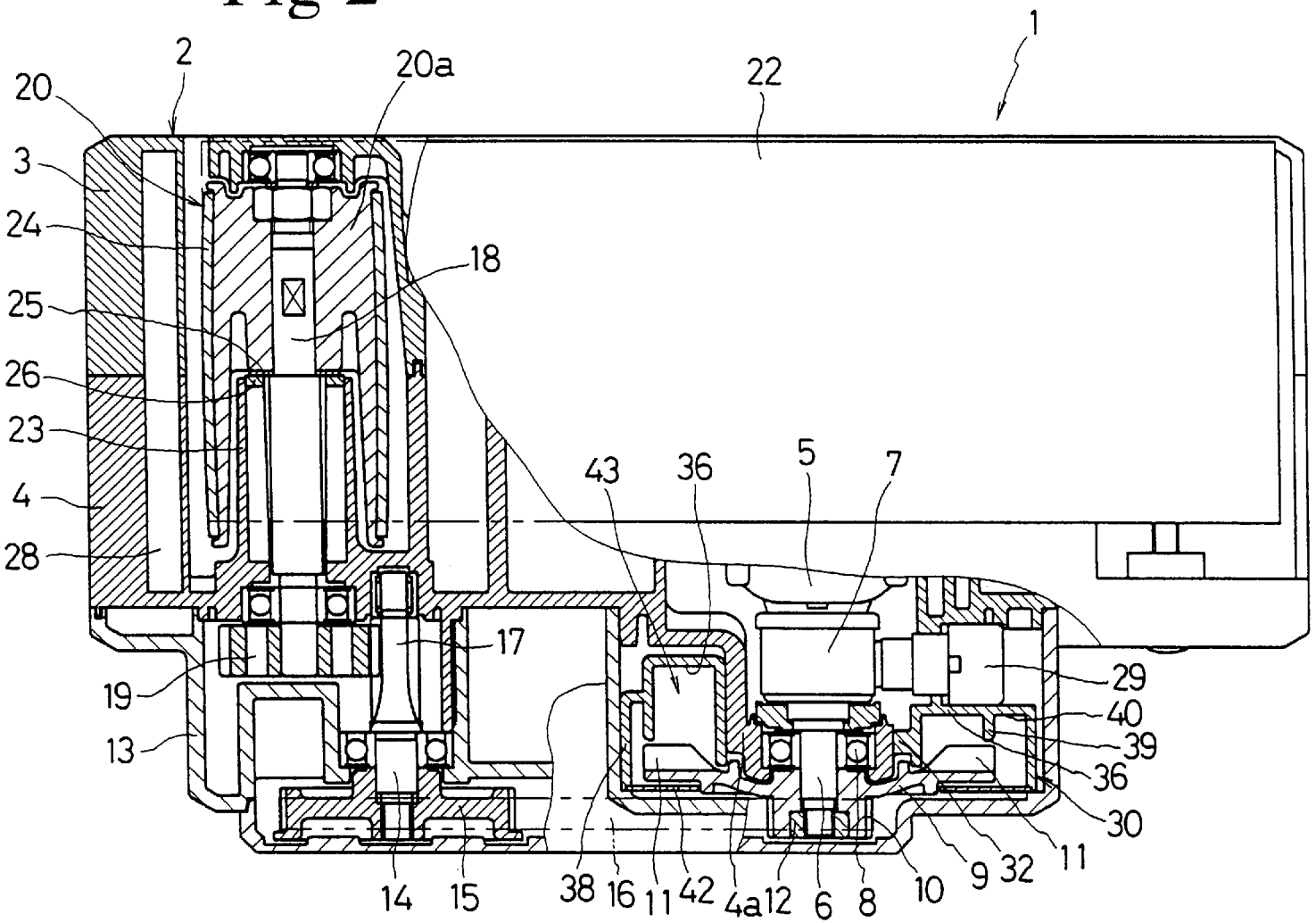
FIG. 2 is a partially cutaway cross-sectional bottom view of the belt sander 1 of FIG. 1.

FIG. 1 is a partial cross-sectional side elevation of a belt sander 1 according to the present invention. FIG. 2 is a partially cutaway cross-sectional bottom view of the belt sander 1 of FIG. 1. Reference numeral 2 indicates a split housing formed by fitting together right and left split molds 3 and 4. Disposed within the upper portion of the housing 2 is a commutator motor 5 with the axis thereof directed at a right angle to the orientation of the belt sander 1 (the feeding direction of an endless abrasive belt 22 as indicated by the arrow in FIG. 2). The shaft 6 of the commutator motor 5 protrudes from the left side (the bottom side of FIG. 2) of the housing 2 while being rotatably supported by a ball bearing 8 at a protruding bearing holder 4*a* formed in the split mold 4. A dust collecting fan 9 is secured to the top of the motor shaft 6 with a nut 12. The dust collecting fan 9 integrally includes an outwardly extending pulley 10 and a plurality of inwardly extending blades 11.

A bracket 13 is secured to the rear left part of the housing 2 (to the left of FIG. 2). An intermediate shaft 14 with a pulley 15 attached to the top end thereof is rotatably supported by the bracket 13 and the housing 2. A synchro belt 16 is trained over the pulley 15 and the pulley 10 of the dust collecting fan 9 so as to transmit the rotation of the motor shaft 6 to the intermediate shaft 14. The intermediate shaft 14 is formed with a helical gear 17 which meshes with a helical gear 19 of a roller shaft 18 rotatably supported at the rear bottom of the housing 2. In this manner, the rotation of the intermediate shaft 14 can be transmitted to the roller shaft 18. In addition, a drive roller 20 is mounted on the outer surface of the roller shaft 18. A driven roller 21 is rotatably supported at the front bottom of the housing 2. The endless abrasive belt 22 is trained over the drive and driven rollers 20 and 21, respectively, so that the endless abrasive belt 22 is rotated around the two rollers when the drive roller 20 is rotated by the commutator motor 5.

The drive roller 20 is a one-piece zinc mold the left half of which is hollowed and the right half of which is substantially solid except where a bore is made to receive the roller shaft 18, with the plane which divides the left and right halves substantially aligned with the division of the right and left split molds 4 and 3. The roller shaft 18 inwardly penetrates the solid portion of the drive roller 20 and the hollow portion is fitted around a cylindrical protrusion 23 formed inwardly from the inner surface of the split mold 4. Reference numeral 24 indicates a rubber sleeve fitted on the outer surface of the drive roller 20. Reference numerals 25 and 26 indicate flat washers interposed between the cylindrical protrusion 23 and the solid portion 20*a* of the drive roller 20 for bearing any axial load. The weight of the drive roller 20 is unevenly distributed with the right half thereof much heavier than the left half in this manner in order to strike a better balance between the two halves and thus improve the operability of the belt sander 1. To further increase the effect of the balance correction, the drive roller 20 is made of zinc, which has a greater specific gravity than aluminum, which is normally used for rollers of this type. Without this balance correction, the intermediate shaft 14 and other rotation transmitting means of the sanding device 1 tend to shift the balance to the left side, thereby affecting the operability of the device. It should be noted that this construction is equally applicable to the driven roller 21.

Figure 3:
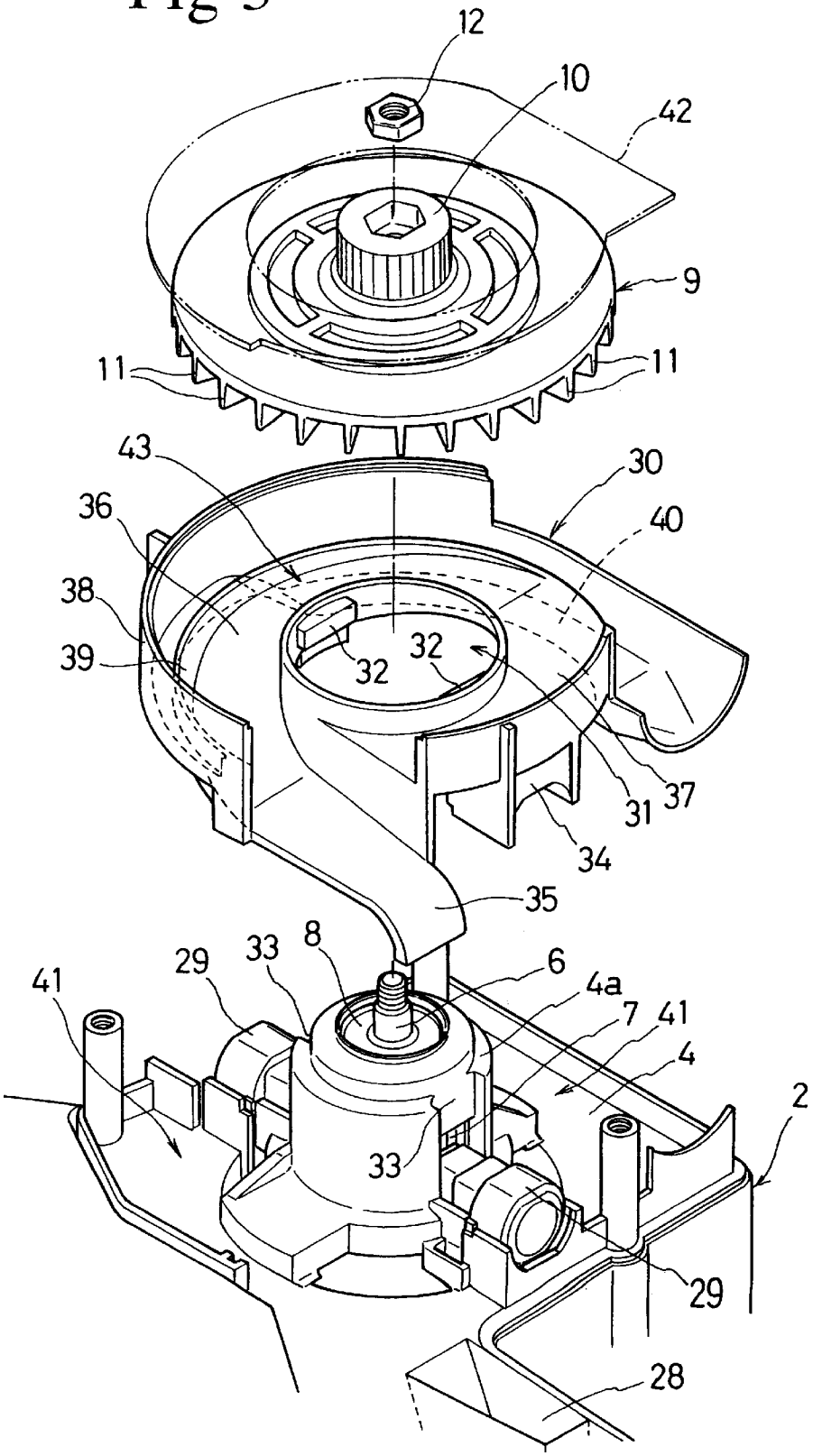
FIG. 3 is an enlarged exploded view in perspective of the structure for collecting dust of FIG. 1.

Still referring to FIGS. 1 and 2, a dust intake 27 is formed in the rear bottom surface of the housing 2 behind the drive roller 20 substantially along the width of the housing 2. A dust intake passage 28 is formed in the housing 2 and is in communication with the dust intake 27. The dust intake passage 28 leads up and around the drive roller 20 within the housing 2 toward the front of the belt sander 1 and, as shown in FIG. 3, opens at an angle in the left side of the housing 2. The commutator 7 of the motor shaft 6 supported at the protruding bearing holder 4*a* is provided with a pair of brush assemblies 29 secured to the left side surface of the housing 2. A scroll plate 30 is interposed between the brush assemblies 29 and the dust collecting fan 9. The scroll plate 30 is a generally dish-shaped element which has a center hole on the circular inner wall of which a pair of aligning tubs 32 is formed. The scroll plate 30 also has a pair of retainers 34 which protrude from the rear surface thereof for abutting the upper surfaces of the brush assemblies 29 when set in place. The plate 30 is set in place by fitting the aligning tubs 32 in a matching pair of guide grooves 33 formed in the protruding bearing holder 4*a*.

The bottom surface of the scroll plate 30 includes a tongue portion 35 having a free, deeper end that is inserted into the dust intake passage 28 substantially in parallel to the motor shaft 6. The tongue portion 35 is connected to an inner ramp 36 that becomes increasingly shallow as it goes approximately halfway around the center hole 31. Also provided is a proximate surface 37 that is connected to the inner ramp 36 and goes approximately halfway around the center hole 31 to be terminated at a step above the tongue portion 35. The proximate surface 37 is positioned close to the blades 11 of the dust collecting fan 9 when the belt sander 1 is assembled. The scroll plate 30 further includes an outer passage 40 that is formed between a rib 39 and a peripheral wall 38 and has a semi-circular cross section. As seen in FIG. 3, the outer passage 40 descends to the same level as the tongue portion 35 at about 90 degrees from its starting point close to the end of the tongue portion 35. The outer passage 40 continues around the center hole 31 approximately another 90 degrees and terminates with a straight portion that extends in parallel with the tongue portion 35. The rib 39 has the same height as the proximate surface 37 and is formed along the outer circumference of the inner ramp 36. The inside of the scroll plate 30 forms a dust chamber 43 which is connected to the dust intake passage 28 at the tongue portion 35 and which is also connected to a spout 46 (see FIG. 4) fitted on the free end of the outer passage 40. According to the above-described configuration of the scroll plate 30, the brush assemblies 29 are positioned under the shallow part of the inner ramp 36 and the center part of the proximate surface 37. In this manner, the tongue portion 35 and the outer passage 40 are provided where they do not overlap the brush assemblies 29 in the axial direction of the motor shaft 6, thus securing large and deep spaces 41 around the motor shaft 6 adjacent the brush assemblies 29. Located in the spaces 41, the tongue portion 35 and the outer passage 40 are formed with opening areas which are deep in the axial direction of the motor shaft 6 at the connections of the dust intake passage 28 and the spout 46 to the dust chamber 43.

Reference numeral 42 indicates a cover plate that is fitted along the peripheral wall 38 of the scroll plate 30 for mounting the dust collecting fan 9 in the scroll plate 30 except for the pulley 10. When the cover plate 42 is fitted over the scroll plate 30, the dust chamber 43 is sealed except at the free ends of the tongue portion 35 and the outer passage 40.

Figure 4:
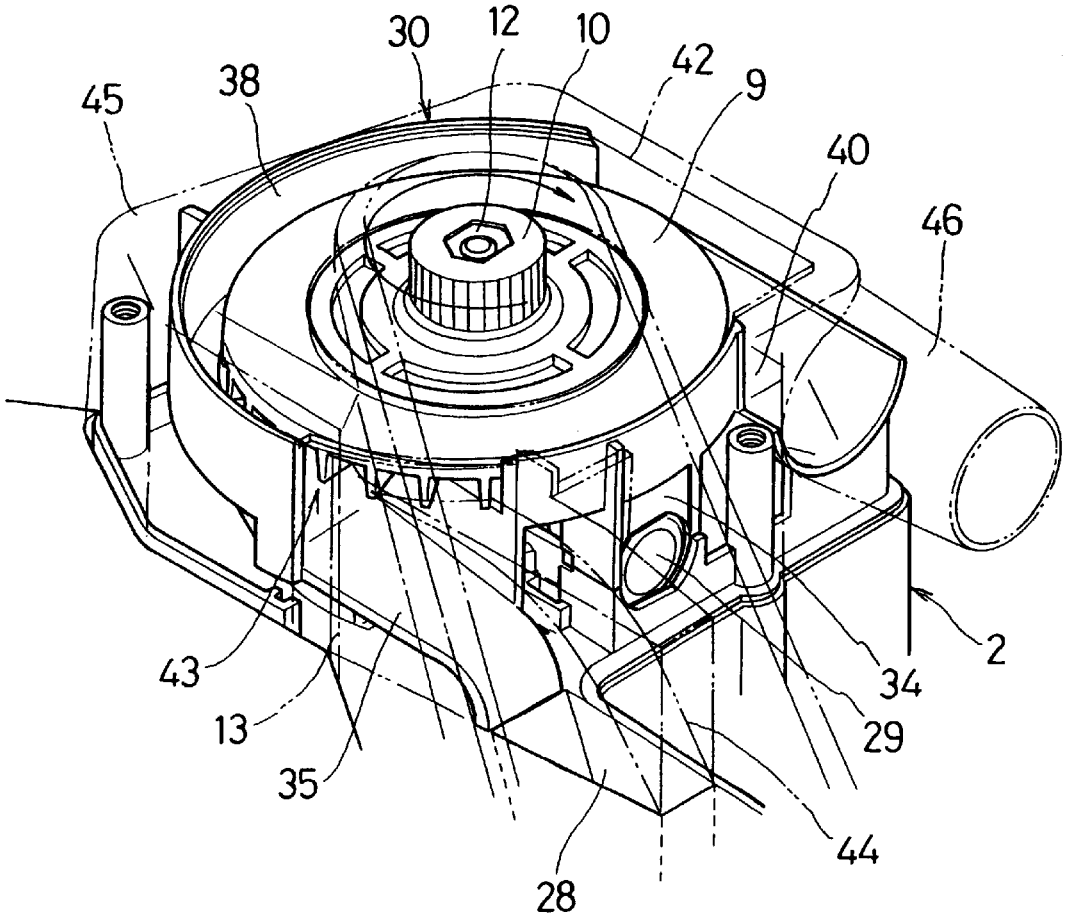
FIG. 4 is a perspective view of the structure for collecting dust of FIG. 1 when it is assembled.

Referring to FIG. 4, the bracket 13 includes a connecting passage 44 that is erected from around the opening of the dust intake passage 28 and connects the opening with the entrance to the dust chamber 43 formed by the tongue portion 35 and the cover plate 42. As shown in FIG. 2, when a cover 45 is mounted on the housing 2, it abuts the edges of the scroll plate 30 and the cover plate 42, thereby securing these elements in place. At the same time, the spout 46 protruding from the cover 45 is coupled to the free end of the outer passage 40, thus completing a dust removal passage which includes the dust intake 27, the dust intake passage 28, the dust chamber 43, and the spout 46. Furthermore, a dust bag or other suitable dust collecting means can be connected to the front end of the spout 46.

In the belt sander 1 constructed as described above, when the commutator motor 5 is operated, the abrasive belt 22 is rotated around the drive roller 20 and the driven roller 21 to grind or polish the workpiece. Meanwhile, the dust collecting fan 9 is rotated to draw dust generated by the grinding into the dust intake passage 28 through the dust intake 27. The dust is further drawn into the connecting passage 44 of the bracket 13 and the dust chamber 43 in the scroll plate 30. As outward airflow is created by the rotation of the blades 11 of the dust collecting fan 9 from the inner ends to the outer ends of the blades 11, the dust travels from the inner ramp 36 to the outer passage 40 in the direction of the fan rotation (indicated by the arrow in FIG. 4). Consequently, the dust exits from the spout 6 and the cover 45 and goes into a dust bag if it is attached to the spout 46.

According to the foregoing embodiment, a sufficient depth in the axial direction of the motor shaft 6 is allocated for the dust removal passage at the tongue portion 35 and the outer passage 40 in the spaces 41 as shown in FIGS. 2 to 4. This maximizes the cross section of the dust removal passage at these locations and reduces the resistance of the passage surface, thus allowing a large airflow through the passage and providing efficient dust collection (FIG. 2 is a double cross section taken radially from the axis of the motor shaft 6 with one section formed by a plane bisecting the inner ramp 36 close to its connection to the tongue portion 35 and another cross section approximately 90 degrees rotated clockwise as seen in FIG. 4 from the first about the axis showing the brush assembly 29 below the inner ramp 36). Since the dead spaces adjacent the brush assemblies 29 are utilized to accommodate the tongue portion 35 and the outer passage 40, the dust collecting fan 9 and the dust chamber 43 do not have to be shifted outward in the axial direction of the motor shaft 6. This construction minimizes the width of the belt sander 1, thereby maintaining the center of gravity within a desirable range. The well-balanced sander 1 is particularly effective in grinding or polishing a wall corner or an edge of a workpiece. If the center of gravity is excessively shifted in the outward direction, a belt sander tends to tilt during operation, thus providing unevenly worked surfaces. Furthermore, since the pulley 10 is integrally formed with the fan 9 as described before, there is no need to provide a separate bearing, thus contributing to an overall reduction in size of the device.

The configuration of the bottom of the scroll plate 30 is not limited to the foregoing embodiment. Many variations are possible to obtain similar effects as long as a suitable airflow is created by (1) protruding a circular rib close to the blades 11 of the dust collecting fan 9 and (2) dividing the bottom of the dust chamber 43 into the inner and outer sides along the rib. For example, the outer diameter of the inner ramp 36 may be narrowed so as to position it further within the outer ends of the fan blades 11. Alternatively, the inner ramp 36 and/or the outer passage 40 may be widened to suit specific applications and purposes.

As other elements may be modified, altered, and changed without departing from the scope or spirit of the essential characteristics of the present invention, it is to be understood that the above embodiments are only an illustration and not restrictive in any sense. The scope or spirit of the present invention is limited only by the terms of the appended claims.

What is claimed is:

1. A structure for use in a power driven tool for collecting dust generated by the operation of the tool, comprising:

an outer housing;

a commutation motor disposed within the housing and including a main shaft which has a tip end and a commutator on the main shaft;

a plurality of brush assemblies radially disposed around, and in contact with, the commutator of the motor;

a dust collecting fan mounted on the main shaft of the commutation motor, and the fan being disposed between the commutator and the outer housing;

a dust intake passage formed within the housing and having an intake formed adjacent the location where dust is generated by the operation of the tool;

a dust discharge passage formed within the housing and having an outlet; and a dust chamber formed substantially between the outer housing and the commutator for containing the dust collecting fan, the dust chamber having a first connecting portion coupled to the dust intake passage and a second connecting portion coupled to the dust discharge passage, wherein the first and second connecting portions are arranged around the main shaft where they do not overlap the brush assemblies in the axial direction of the main shaft, wherein the plurality of brush assemblies include a first brush assembly and a second brush assembly, the first brush assembly being positioned diametrically opposite the second brush assembly about the axis of the motor shaft, further wherein the commutator has a substantially cylindrical shape having a first flat surface distal to the tip end of the main shaft and a second flat surface proximal to the tip end of the main shaft, and further wherein the first and second connecting portions of the dust chamber are arranged on the opposite sides of a plane passing through the first brush assembly, the axis of the main shaft, and the second brush assembly, and extend in the axial direction of the main shaft substantially from the plane in which the first flat surface of the commutator is located to the plane in which the second flat surface of the commutator is located.

2. A structure in accordance with claim 1, wherein the dust chamber comprises a scroll plate having an open top and a bottom surface opposing the open top and a cover fitted over the open top of the scroll plate, the scroll plate having a first level proximal to the top end of the main shaft, a second level distal to the top end of the main shaft, and at least one ramp connecting the two levels, the first and second brush assemblies being located immediately outside the scroll plate and adjacent to the first level.

3. A structure in accordance with claim 2, wherein the dust chamber has a substantially cylindrical shape and the first and second connecting portions are located in the peripheral wall of the cylindrical dust chamber.

4. A structure in accordance with claim 1, further comprising a scroll plate having a center hole through which the tip end of the main shaft of the commutator motor protrudes such that the dust collecting fan is mounted on the main shaft inside the dust chamber between the scroll plate and a cover, further wherein the dust collecting fan has a center portion which is mounted on the main shaft and a plurality of blades extending radially from the center portion at right angles to the main shaft of the motor, each blade having an inner end connected to the center portion and outer free end, and further wherein a circular rib is erected in the axial direction of the main shaft from the bottom surface along, and close to, the outer ends of the blades of the dust collecting fan so as to substantially and circularly divide the dust chamber into an inner side and an outer side along the outer ends of the blades, the inner side being connected to the dust intake passage and the outer side being connected to the dust discharge passage.

5. A structure for use in a power driven tool for collecting dust generated by the operation of the tool, comprising an outer housing, a commutation motor disposed within the housing and having a main shaft extending along an axis and a commutator disposed on the shaft, first and second brush assemblies radially disposed about the commutator, dust collecting fan mounted on the main shaft of the commutation motor, the fan being disposed between the commutator and the outer housing, a dust intake passage formed within the housing and having an intake formed adjacent the location where dust is generated by the operation of the tool, a dust discharge passage formed within the housing and having an outlet, and a dust chamber formed substantially between the outer housing and the commutator for containing the dust collecting fan, the dust chamber having a first connecting portion coupled to the dust intake passage and a second connecting portion coupled to the dust discharge passage, wherein the first brush assembly is radially spaced from the second brush assembly about the axis of the shaft, and wherein the first and second connecting portions of the dust chamber are arranged on opposite sides of a plane passing through the axis of the main shaft and at least one of the first and second brush assemblies.

6. A structure in accordance with claim 5, wherein the commutator comprises a first flat surface distal to a tip end of the main shaft and a second flat surface proximal to the tip end of the main shaft, and where the first and second connecting portions of the dust chamber extend along the axis of the main shaft substantially from a first plane passing through the first flat surface to a second plane passing through the second flat surface.

7. A structure in accordance with claim 5, wherein the first brush assembly is positioned diametrically opposite the second brush assembly.

8. A structure in accordance with claim 5, wherein the first and second connecting portions of the dust chamber are arranged about the main shaft such that they do not overlap the first and second brush assemblies along the axis of the main shaft.

9. A structure in accordance with claim 5, wherein the dust chamber, the dust collecting fan and the first and second brush assemblies are all disposed at a first end of the main shaft on one side of the motor to form a relatively compact power driven tool.

10. A structure for use in a power driven tool for collecting dust generated by the operation of the tool, comprising an outer housing, a commutation motor disposed within the housing and having a main shaft extending along an axis and a commutator disposed one a first end of the shaft, first and second brush assemblies radially disposed about the commutator and positioned at the first end of the shaft, a dust collecting fan disposed at the first end of the shaft and mounted on the main shaft of the commutation motor, the fan being disposed between the commutator and the outer housing, a dust intake passage formed within the housing and having an intake formed adjacent the location where dust is generated by the operation of the tool, a dust discharge passage formed within the housing and having an outlet, and a dust chamber formed substantially between the outer housing and the commutator for containing the dust collecting fan, the dust chamber being positioned at the first end of the shaft and includes a first connecting portion coupled to the dust intake passage and a second connecting portion coupled to the dust discharge passage, wherein the dust chamber, the fan and the first and second brush assemblies are all disposed at the first end of the shaft on one side of the motor adjacent the commutator to form a relatively compact power driven tool.

* * * * *

UNITED STATES PATENT AND TRADEMARK OFFICE

CERTIFICATE OF CORRECTION

PATENT NO : 6,159,085

DATED : December 12, 2000

INVENTOR(S) : Akihito Hara

It is certified that error appears in the above-identified patent and that said Letters Patent are hereby corrected as shown below:

Page 8, line 29, please delete "one" and insert --on--; and
line 46, please delete "includes" and insert --including--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*